US005402396A

United States Patent [19]

Jones, Jr.

[11] Patent Number: 5,402,396

[45] Date of Patent: Mar. 28, 1995

[54] SUNRISE ALARM CLOCK RADIO

[75] Inventor: Charley G. Jones, Jr., Kansas City, Mo.

[73] Assignee: Sony Electronics Inc., Park Ridge, N.J.

[21] Appl. No.: 19,637

[22] Filed: Feb. 18, 1993

[51] Int. Cl.[6] ..... G04C 21/00

[52] U.S. Cl. ..... 368/250; 368/75; 368/10; 368/73; 368/249

[58] Field of Search ..... 368/250, 249, 256, 10, 368/75, 73

[56] References Cited

U.S. PATENT DOCUMENTS

| | | | |
|---|---|---|---|
| Re. 23,261 | 8/1950 | Parissi | 268/75 |
| 2,589,978 | 6/1952 | De Martin | 368/75 |
| 3,509,711 | 5/1970 | Kaniwec | 368/75 |
| 3,754,130 | 8/1973 | Stone et al. | 362/29 |
| 4,015,417 | 4/1977 | Kitai et al. | 368/249 |
| 4,093,944 | 6/1978 | Muncheryan . | |
| 4,186,389 | 1/1980 | Flittie . | |
| 4,321,591 | 3/1982 | Vieweg . | |
| 4,540,980 | 9/1985 | Porco . | |
| 4,611,200 | 9/1986 | Stilwell . | |
| 4,777,474 | 10/1988 | Clayton . | |
| 4,949,077 | 8/1990 | Mbuthia . | |
| 5,212,672 | 5/1993 | Loisch | 368/752 |

OTHER PUBLICATIONS

Tandy Radio Shack advertisement, "Neon-light alarm clock" (Sheet 1).

Tandy Radio Shack advertisement "Chronomatic-264 with Built-in Night Light" (Sheet 2).

Tandy Radio Shack advertisement "Rise 'n Shine" (Sheet 3).

*Primary Examiner*—Bernard Roskoski

*Attorney, Agent, or Firm*—Ronald P. Kananen

[57] ABSTRACT

In order to avoid erroneous manipulation of alarm ON/OFF and sleep buttons, on a clock radio type alarm, a night light is provided to illuminate at least these two buttons when the alarm ON/OFF button is set to it's ON position. An illumination level control is provided which allows the brightness of the night light to be selective controlled or turned off irrespective of the alarm button being set to its ON position. The night light preferably includes two readily replaceable bulbs which are circuited in such a manner that when one becomes defective, the other can be still be energized.

3 Claims, 2 Drawing Sheets

SUNRISE ALARM CLOCK RADIO

BACKGROUND OF THE INVENTION

1. Field of the Invention

The present invention relates generally to alarm clocks such as the radio-alarm clock type wherein a so-called sleep button is provided in addition to an alarm ON/OFF button, and more specifically such a device which is provided with a night-light which enables the above-mentioned control buttons to be illuminated when the alarm is on.

2. Description of the Prior Art

Commonly used clock radios are inevitably provided with a button which allows the alarm function to set either on or off along with a button which allows the radio to be switched off (so called sleep button) until such time as the alarm sounds. However, as it is often dark when the person attempts to manipulate the sleep button, it is possible that the ON/OFF button is accidentally pressed instead. This of course cancels the alarm function and prevents the alarm from sounding and/or the radio being switched back on at the appropriate time.

Alternatively, if the alarm is set and the sleep button correctly manipulated before sleeping, upon the alarm sounding (viz., either buzzer and/or the radio being switched on), as it is possible that the room is still dark, it is possible that instead of pressing the snooze button to provide another few minutes slumber, the ON/OFF button is accidentally pressed. This of course again invites the problem wherein a person or persons are apt to oversleep.

SUMMARY OF THE INVENTION

It is an object of the present invention to provide a night light which is switched on while the alarm is on and thus illuminate the controls in a manner which attenuates the chances that one will accidentally manipulate the incorrect button/switch in dark or poorly lit environments.

In brief, the above object is achieved by an arrangement wherein a clock radio type alarm is provided with a night-light which can illuminate at least the alarm ON/OFF button and the so called sleep button when the alarm ON/OFF button is set to its ON position. An illumination level control is provided which allows the brightness of the night light to be selective controlled or turned off irrespective of the alarm button being set to it's ON position. The night light preferably includes two readily replaceable bulbs which are circuited in such a manner that when one becomes defective, the other can be still be energized.

More specifically, the present invention features an alarm device comprising: first and second manually manipulatable buttons operatively mounted on a housing; an energizable light source mounted on the housing so that the first and second buttons are illuminated when the light source is illuminated; and circuit means associated with the light source for supplying electrical power thereto in response to a predetermined manipulation of the first button.

BRIEF DESCRIPTION OF THE DRAWINGS

The present invention will become more clearly appreciated as a description of the preferred embodiment is made with reference to the appended drawings in which.

DETAILED DESCRIPTION OF THE PREFERRED EMBODIMENT

Figure 1:
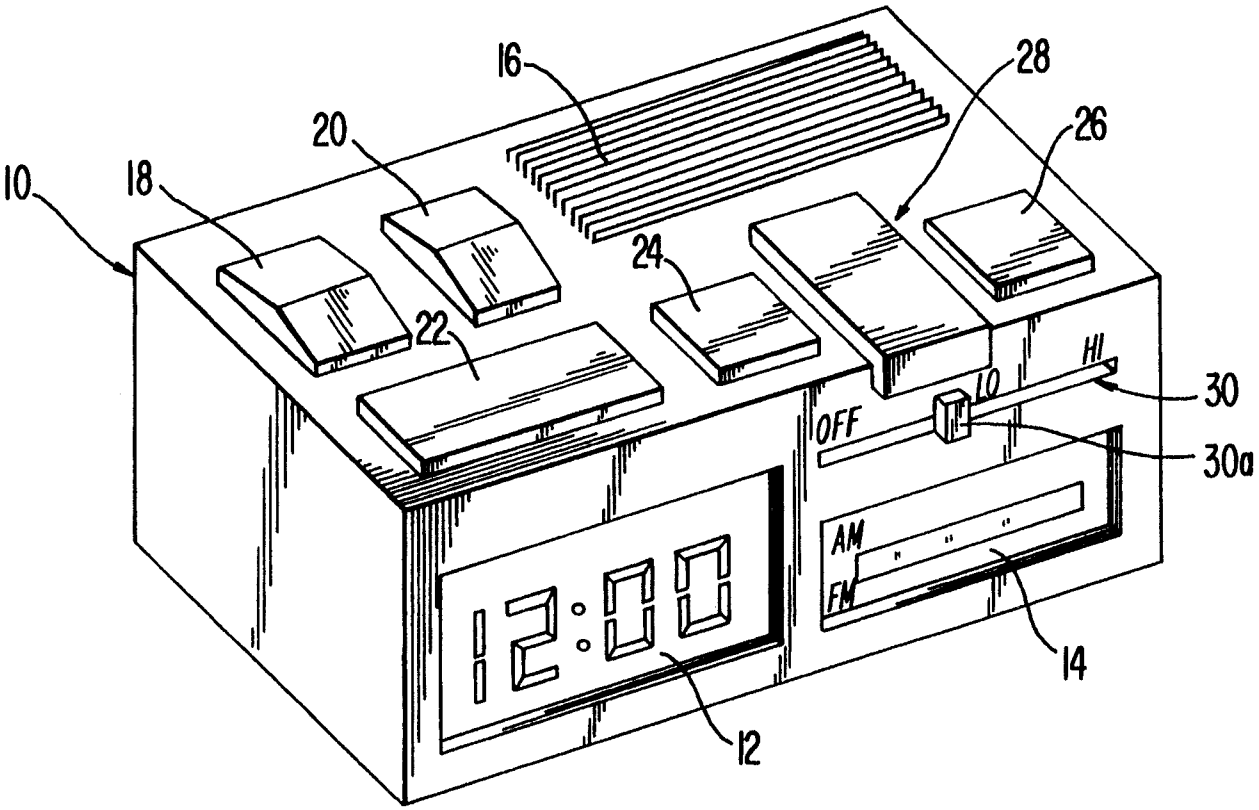
FIG. 1 is a perspective sketch showing a radio alarm which is equipped with a night light according to the present invention.

FIG. 1 is a sketch which depicts an embodiment of the present invention. In this figure, a radio clock/alarm 10 includes a time display 12 (in this instance a digital type display) and a dial 14 by way of which the radio station setting can be ascertained. The dial 14 can be of the analog or digital type.

In addition to a speaker 16 (only the cover is visible), a plurality of buttons are arranged on the top of the device 10. Merely by way of example, these buttons include a time adjust button 18, station adjust button 20, a snooze button 22, a alarm ON/OFF button 24 and a sleep button 26. Merely by way of example, the time and station adjust buttons can be of the rocker type, so that tilting in one direction induces a count up, and tilting in the other direction induces a down counting.

In accordance with the present invention a night-light 28 is disposed between the alarm ON/OFF button 24 and the sleep button 26. In this instance, the night-light 28 includes two bulbs (see #40, 42 in FIG. 2) which are enclosed by removable translucent cover. This cover is arranged to project slightly above the surface of the clock body and to slightly curve down onto the face of the device.

A switch 30 which enables the level of the light to be controlled is located on the face of the device below the above mentioned overhang. In this embodiment, the switch allows the night-light to be switched off or set at either a high or low setting.

Simply by way of example, it could be envisaged that the translucent cover by adapted to permit light to be more readily transmitted through the side edges of the same. With this provision, the ON/OFF, sleep buttons 24, 26 and level control switch 30 can be specifically illuminated. Viz., it is the ON/OFF and sleep buttons 24, 26 which are apt to cause the most trouble if accidentally manipulated in an unintentional manner, and thus by ensuring that these buttons are well illuminated, the chances of accidental mismanipulation can be greatly attenuated.

However, it will be understood that as there are a large number of different alarm device designs on the market, the invention is by no way limited to this provision and that the night light (or even night lights) can be suitably located at any desired/suitable position. It could be even envisioned that the ON/OFF and sleep buttons 24, 26 be rendered translucent and for light produced by the night light be allowed to be transmitted therethrough.

Figure 2:
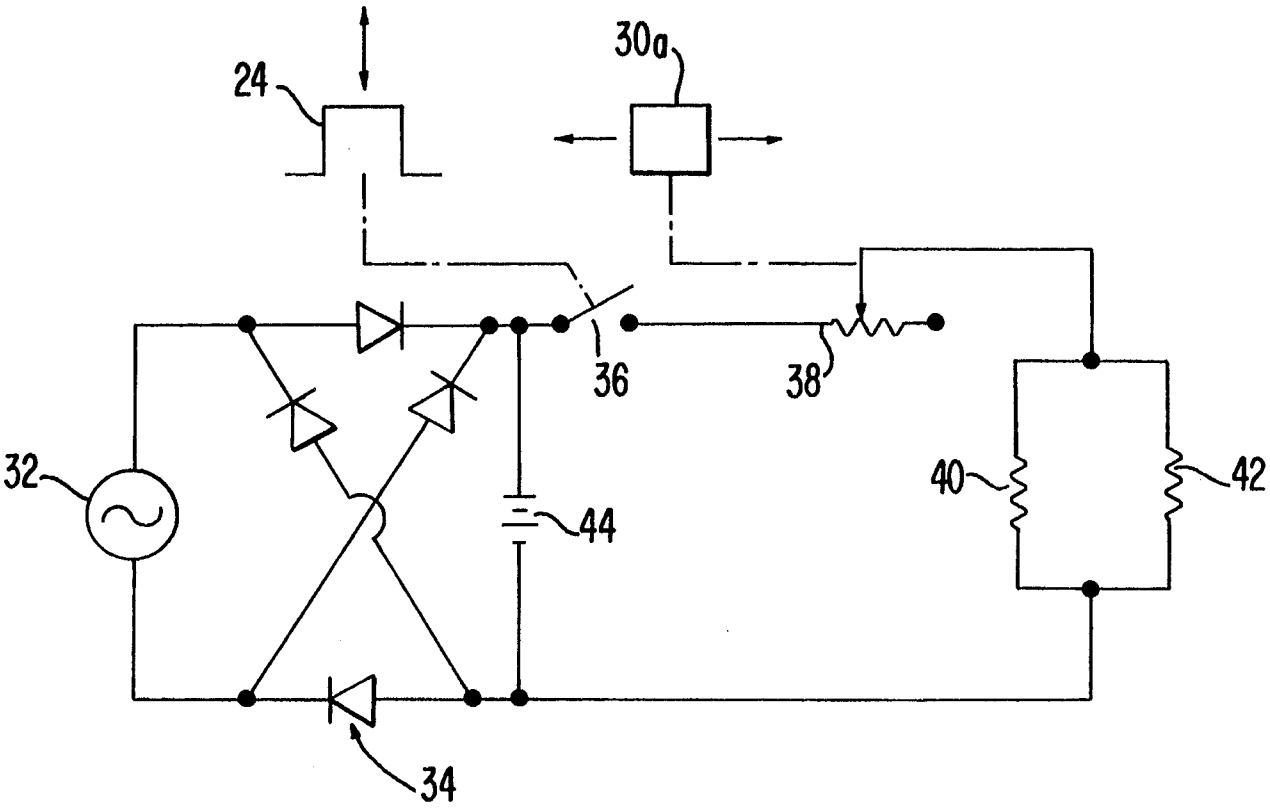
FIG. 2 is a circuit diagram which shows an example of how the night light according to the present invention can be arranged.

FIG. 2 shows an example of the type of circuitry which can be used in connection with the embodiment of the invention. In the illustrated arrangement an AC source 32 (e.g. a household outlet) is connected with a AC/DC converter 34 (a signal phase bridge circuit) in a manner which converts the AC current into DC form. The ON/OFF button 24 is operatively connected with a switch 36 which is arranged to be closed when the ON/OFF button 24 is set to an activated position wherein the alarm is switched on (viz., set so that when a given time is reached the alarm will sound). This switch 36 is circuited in series with a variable resistor 38. As shown, the variable resistor is operatively connected with a knob 30*a* of the level control switch 30.

As will be understood, this variable resistor 38, in this embodiment, forms a vital part of the level control switch 30. Although not specifically shown in this drawing, in accordance with the illustrated embodiment, the knob 30*a* can be moved to a position wherein the resistance provided by the variable resistor 38 exhibits an extremely to infinitely high resistance or wherein the circuit is broken. This is necessary in order to enable the night-light to be selectively switched off irrespective of the fact that the alarm function has been activated and switch 36 has been accordingly closed.

In accordance with the preferred embodiment, the night-light employs two readily replaceable light bulbs (schematically illustrated as resistors 40, 42) such as used in flashlights or the like. These two lights 40, 42 are arranged so that if one should burn out, one of the two will be left operable. This provision not only provides a kind of fail-safe, it also enable the user to understand that one of the bulbs has ceased to operate. Viz., the maximum amount of light which can be produced by the night light will be reduced and the user will be able to visually detect the change.

It is also within the scope of the present invention to provide a back-up battery which enables the night-light to continue functioning even in the event that the AC source 32 is disconnected. In the event that such a provision is required, a battery 44 can be connected in the illustrated position (by way of example). Depending on the remaining circuitry of the clock and radio, it is additionally within the scope of the present invention that this battery be of the rechargeable type and also serve as back-up power supply for other clock/radio/alarm functions.

What is claimed is:

1. An alarm device comprising:

first and second manually manipulatable buttons operatively mounted on a housing, said first button being an alarm ON/OFF button which controls an alarm function and enables the alarm function to be enabled when manually manipulated;

a single energizable light source mounted on said housing at a position discrete from said first and second buttons so that said first and second buttons are simultaneously illuminated when said light source is illuminated;

alarm time setting means for setting a time at which an alarm signal is to be produced; and circuit means associated with said light source for supplying electrical power thereto in immediate response to a predetermined manipulation of said first button which enables the alarm device to be energized and produce an alarm signal at the time set by said alarm time setting means, wherein said light source includes means for manually varying the level of illumination produced thereby continuously between first and second limits when supplied with electrical energy by said circuit means, said level controlling means comprising a switch having a manually manipulatable member, said manually manipulatable member being arranged to be illuminated by said light source when said light source is energized.

2. An alarm device as set forth in claim 1, wherein said circuit means includes means connectable with a source of AC electricity.

3. An alarm device comprising:

first and second manually manipulatable buttons operatively mounted on a housing, said first button being an alarm ON/OFF button which controls an alarm function and enables the alarm function to be enabled when manually manipulated;

a single energizable light source mounted on said housing at a position discrete from said first and second buttons so that said first and second buttons are simultaneously illuminated when said light source is illuminated:

alarm time setting means for setting a time at which an alarm signal is to be produced; and circuit means associated with said light source for supplying electrical power thereto in immediate response to a predetermined manipulation of said first button which enables the alarm device to be energized and produce an alarm signal at the time set by said alarm time setting means, wherein said light source comprises a cover, said cover being so configured as to project above the surface of said housing and to direct light mere readily toward and onto said first and second buttons.

* * * * *